US007828242B2

(12) United States Patent
Snitselaar

(10) Patent No.: US 7,828,242 B2
(45) Date of Patent: Nov. 9, 2010

(54) REUSABLE TAKE-APART SPOOL AND METHODS

(75) Inventor: William A. Snitselaar, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 122 days.

(21) Appl. No.: 12/181,546

(22) Filed: Jul. 29, 2008

(65) Prior Publication Data

US 2010/0025521 A1 Feb. 4, 2010

(51) Int. Cl.
*B65H 75/14* (2006.01)

(52) U.S. Cl. ..... 242/608.2; 242/609.1

(58) Field of Classification Search ... 242/608.2–608.7, 242/609.1, 118.6, 118.61
See application file for complete search history.

(56) References Cited

U.S. PATENT DOCUMENTS

| | | | | |
|---|---|---|---|---|
| 2,047,434 | A | 7/1936 | Schurmann | |
| 3,552,677 | A * | 1/1971 | Hacker | 242/118.61 |
| 3,717,315 | A | 2/1973 | Kovaleski | |
| 3,785,584 | A * | 1/1974 | Crellin, Jr. | 242/118.6 |
| 3,822,841 | A | 7/1974 | Campbell | |
| 3,970,268 | A | 7/1976 | Sheetz | |
| 4,903,913 | A | 2/1990 | McCaffrey | |
| 5,242,129 | A | 9/1993 | Bailey et al. | |
| 5,575,437 | A | 11/1996 | Campbell | |
| 5,605,305 | A | 2/1997 | Picton | |
| 6,062,506 | A | 5/2000 | Eck et al. | |
| 6,241,181 | B1 | 6/2001 | Campbell | |

(Continued)

FOREIGN PATENT DOCUMENTS

DE 4202218 7/1993

(Continued)

*Primary Examiner*—Sang Kim
(74) *Attorney, Agent, or Firm*—Merchant & Gould P.C.

(57) ABSTRACT

A reusable take-apart washable spool includes a first flange having a first flange wall with inner and outer opposite sides. The inner side of the first flange wall is convex. The spool has a second flange having a second flange wall. The second flange wall has inner and outer opposite sides. The second flange wall inner side is convex. A barrel having a loading surface connects the first flange and the second flange so that the first flange inner side faces the second flange inner side. The barrel is removably connected to each of the first flange and second flange. A kit for assembling a reusable take-apart spool includes a pair of flanges and a barrel. The barrel has a first end that is constructed and arranged to be removably connected to a hub on one of the flanges. The barrel has a second end that is constructed and arranged to be removably connected to a hub on the other of the flanges. A method of using a spool includes orienting a projection arrangement of a first end of a barrel into a recess arrangement of a hub of a first flange; orienting a first cord through the projection arrangement and recess arrangement to lock the first flange to the barrel; orienting a projection arrangement of a second end of the barrel into a recess arrangement of a hub of a second flange; orienting a second cord through the projection arrangement of the second end of the barrel and recess arrangement of the second flange to lock the second flange to the barrel; and winding material onto the barrel.

20 Claims, 8 Drawing Sheets

U.S. PATENT DOCUMENTS

| | | | | |
|---|---|---|---|---|
| 7,073,746 | B2 | 7/2006 | Lorenzo Barroso | |
| 2003/0146333 | A1* | 8/2003 | Couchey et al. | 242/476.1 |
| 2007/0181739 | A1 | 8/2007 | Derendal | |
| 2007/0241226 | A1* | 10/2007 | Manzo | 242/608.3 |
| 2008/0078858 | A1 | 4/2008 | Chiorgno et al. | |

FOREIGN PATENT DOCUMENTS

| | | |
|---|---|---|
| EP | 0404043 | 12/1990 |
| FR | 2691448 | 11/1993 |
| JP | 2005246355 | 9/2005 |

* cited by examiner

REUSABLE TAKE-APART SPOOL AND METHODS

TECHNICAL FIELD

This disclosure relates to spools that are used for holding materials used in manufacturing, such as zipper closures for use in bag making. In particular, this disclosure relates to spools that can be reused.

BACKGROUND

Spools are used in manufacturing environments to hold materials that are stored on the spools and then unwound from the spool for use. One example is zipper closures. Zipper closures can be made in advance through methods, such as extrusion. These pre-made zipper closures are extruded in long lengths and then wound onto a spool. Zipper closure can then be unwound from the spool while manufacturing a bag. Of course, there are many other uses for spools, and holding extruded lengths of zipper closures is just one example.

Due to a variety of reasons, spools are typically not washed for re-use. This leads to a large amount of waste once the wound product is consumed. Improvements are desirable.

SUMMARY

To address the deficiencies in the prior art, a reusable take-apart washable spool is provided. The spool includes a first flange having a first flange wall with inner and outer opposite sides. The inner side of the first flange wall is convex. The spool has a second flange having a second flange wall. The second flange wall has inner and outer opposite sides. The second flange wall inner side is convex. A barrel having a loading surface connects the first flange and the second flange so that the first flange inner side faces the second flange inner side. The barrel is removably connected to each of the first flange and second flange.

In another aspect, a kit for assembling a reusable take-apart spool is provided. The kit includes a pair of flanges and a barrel. The barrel has a first end that is constructed and arranged to be removably connected to a hub on one of the flanges. The barrel has a second end that is constructed and arranged to be removably connected to a hub on the other of the flanges.

In another aspect, a method of using a spool is provided. The method includes orienting a projection arrangement of a first end of a barrel into a recess arrangement of a hub of a first flange. The first flange has an inner convex side facing the barrel. Next, the method includes orienting a first cord through the projection arrangement and recess arrangement to lock the first flange to the barrel. Next, the method includes orienting a projection arrangement of a second end of the barrel into a recess arrangement of a hub of a second flange. The second flange has an inner convex side facing the barrel and facing the first flange. Next, the method includes orienting a second cord through the projection arrangement of the second end of the barrel and recess arrangement of the second flange to lock the second flange to the barrel. Next, the method includes winding material onto the barrel.

Preferably, after unwinding material from the barrel, the spool is disassembled by removing the first cord and the second cord to separate each of the first flange, barrel, and second flange. Other aspects are provided and can be appreciated by reading the detailed description.

DETAILED DESCRIPTION

Figure 1:
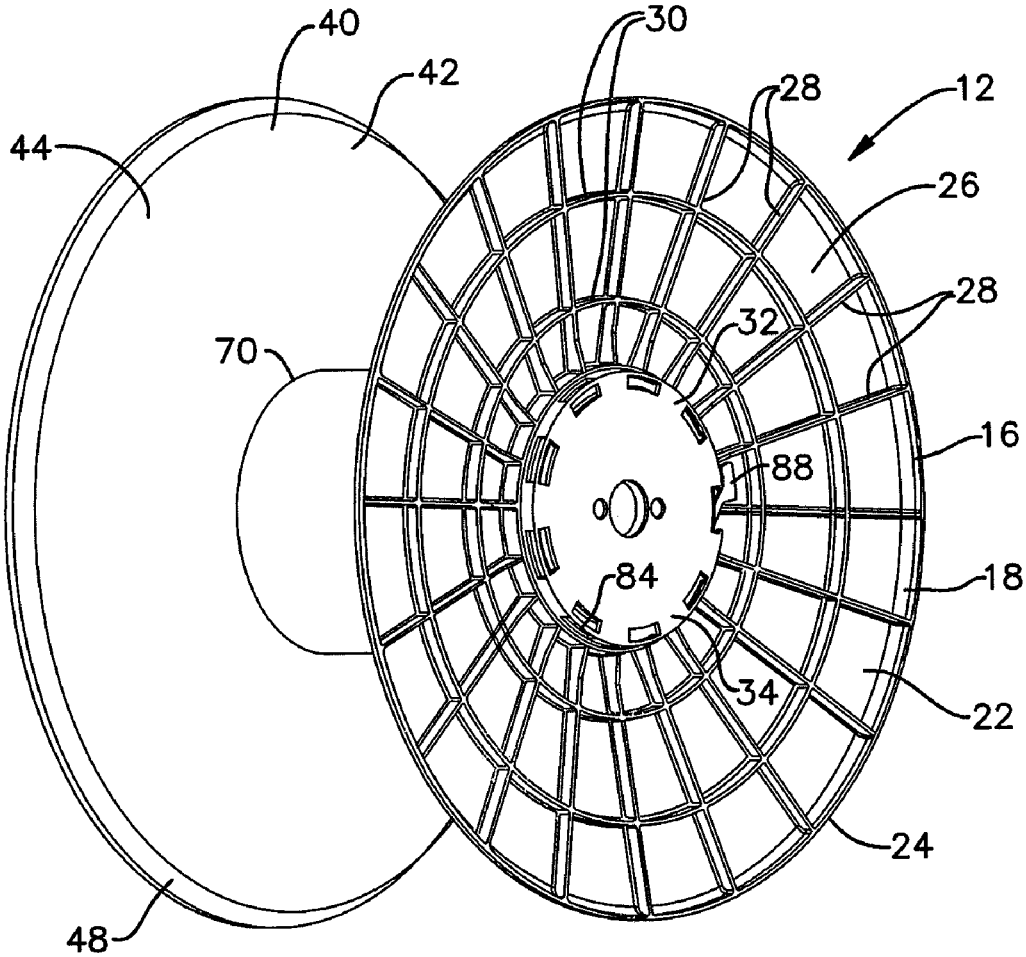
FIG. 1 is a perspective view of a first embodiment of a reusable take-apart spool constructed in accordance with principles of this disclosure.
Figure 3:
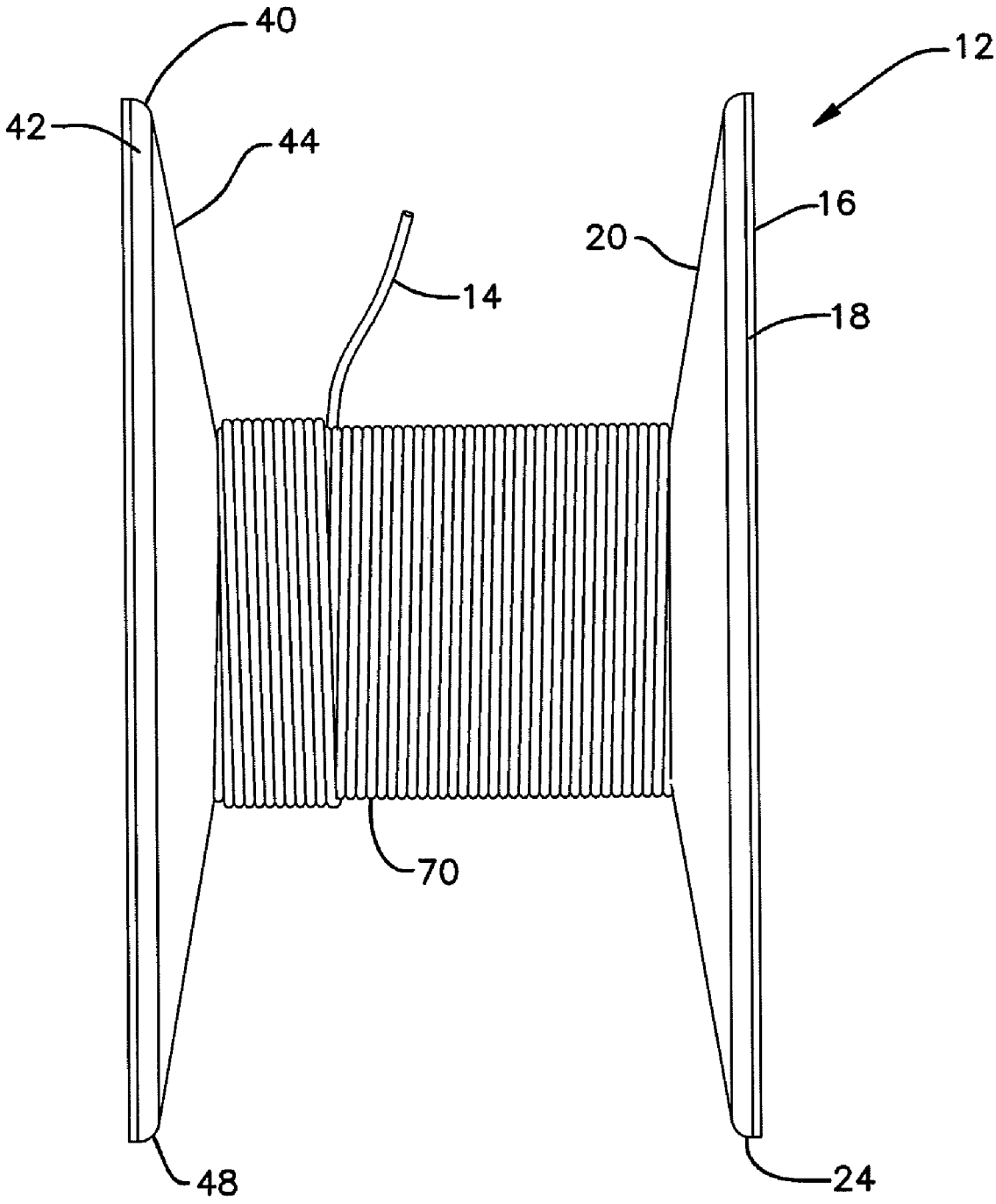
FIG. 3 is a front elevational view of the spool of FIG. 1 and loaded with a material for use.

FIG. 1 illustrates a perspective view of one embodiment of a reusable take-apart washable spool shown at 12. The spool 12 can be used to store any type of material that comes in extended lengths and is convenient for storing by way of winding. FIG. 3 illustrates the spool 12 holding wound product 14. The wound product 14 can include, for example, a strand of zipper closure.

Figure 2:
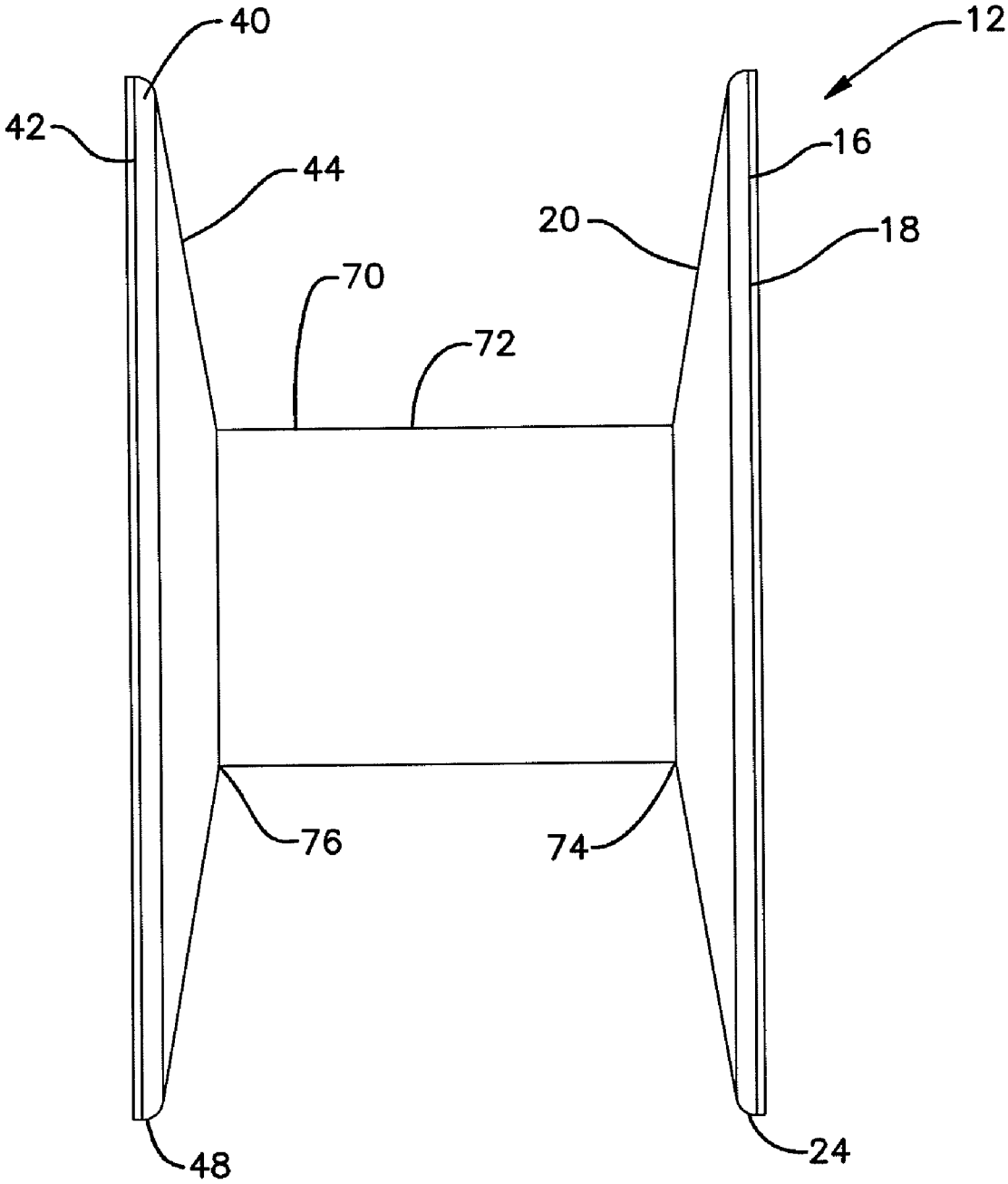
FIG. 2 is a front elevational view of the spool of FIG. 1.

In accordance with principles of this disclosure, the spool 12 includes a first flange 16. In the embodiment shown, the first flange 16 has a first flange wall 18. the first flange wall 18, when assembled in use, has an inner side 20 (FIG. 2) and an opposite outer side 22. The spools 12 used in accordance with principles of this disclosure are generally spools for industrial or manufacturing use, and as such, the first flange wall 18 has an outer circular rim 24 with a diameter of at least 6 inches. The diameter can be no greater than 40 inches, and will typically be between 8-36 inches.

In accordance with principles of this disclosure, the inner side 20 of the first flange wall 18 is convex in shape. This convex shape helps to prevent a problem of the product 14 being caught in the side, where the product 14 gets pulled into a gap formed between the layers of the product 14 and the flange 16. When there is a problem of the product 14 being caught in the side, it often renders the product 14 useless because it becomes too difficult to extract or untangle the product 14. Thus, the convex shape to the inner side 20 is provided and helps to prevent this issue.

Typically, the convex shape of the first flange wall 18 will range from 1 degree to 30 degrees to facilitate side support for product 20 wound on the spool 12. Typical ranges will be from 5 degrees to 25 degrees, and in the embodiment shown, the angle is about 10 degrees. In the embodiment shown, the first flange outer side 22 is concave in shape. As can be seen in FIG. 1, the flange outer side 22 includes a web arrangement 26. The web arrangement 26 includes a plurality of radially extending webs 28 and circumferentially extending webs 30 that are used for strength for the first flange 16.

Figure 4:
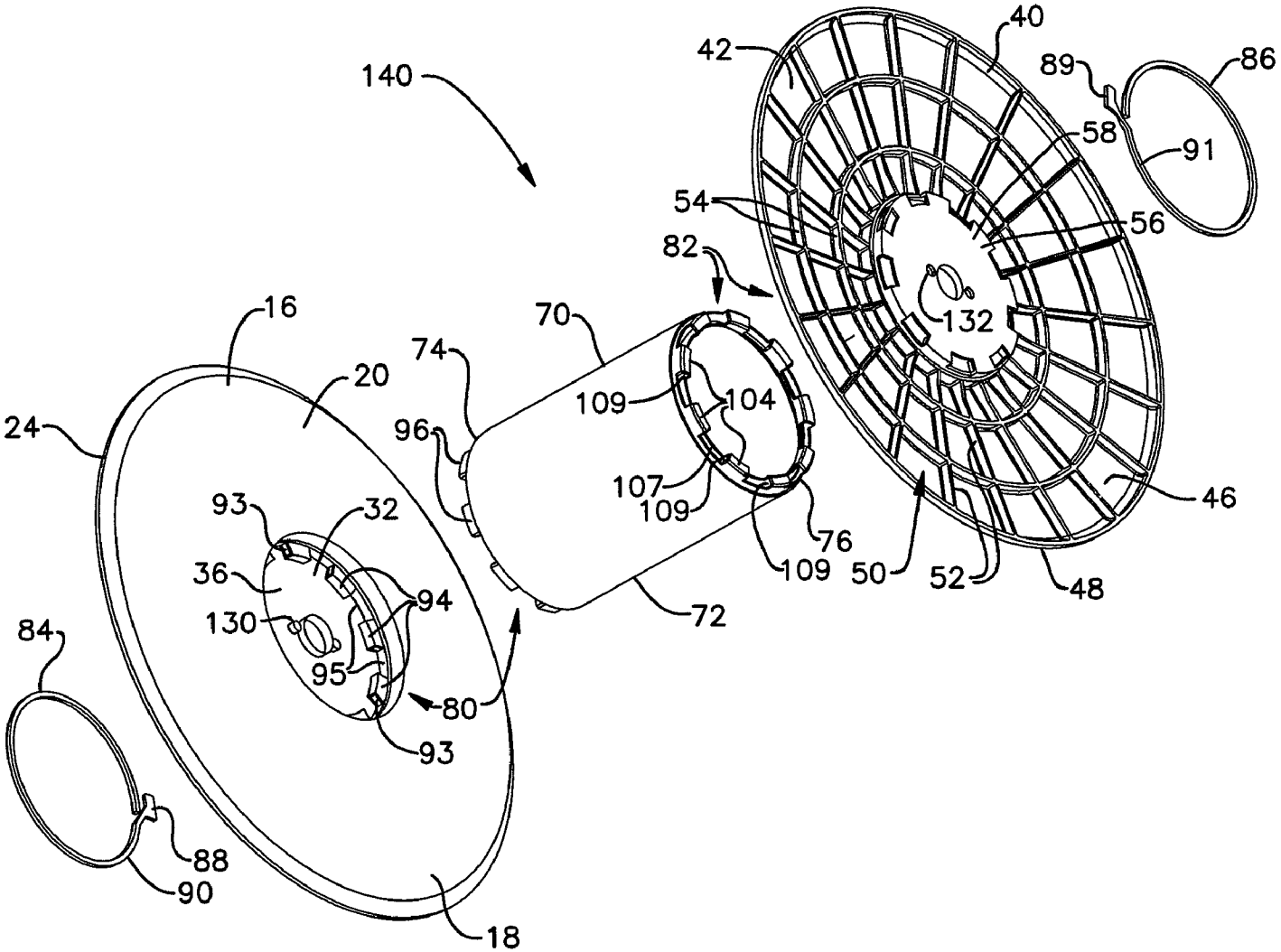
FIG. 4 is an exploded perspective view of a kit for assembling the spool of FIG. 1.
Figure 6:
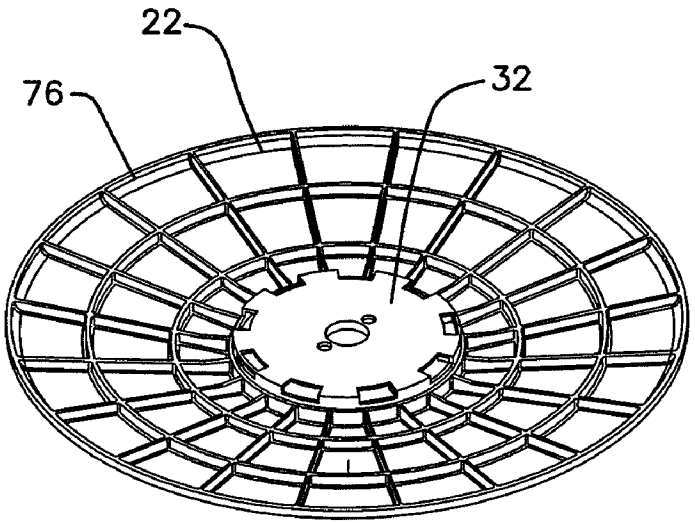
FIG. 6 is a perspective view of an opposite side of one of the spool parts shown in FIG. 5.
Figure 5:
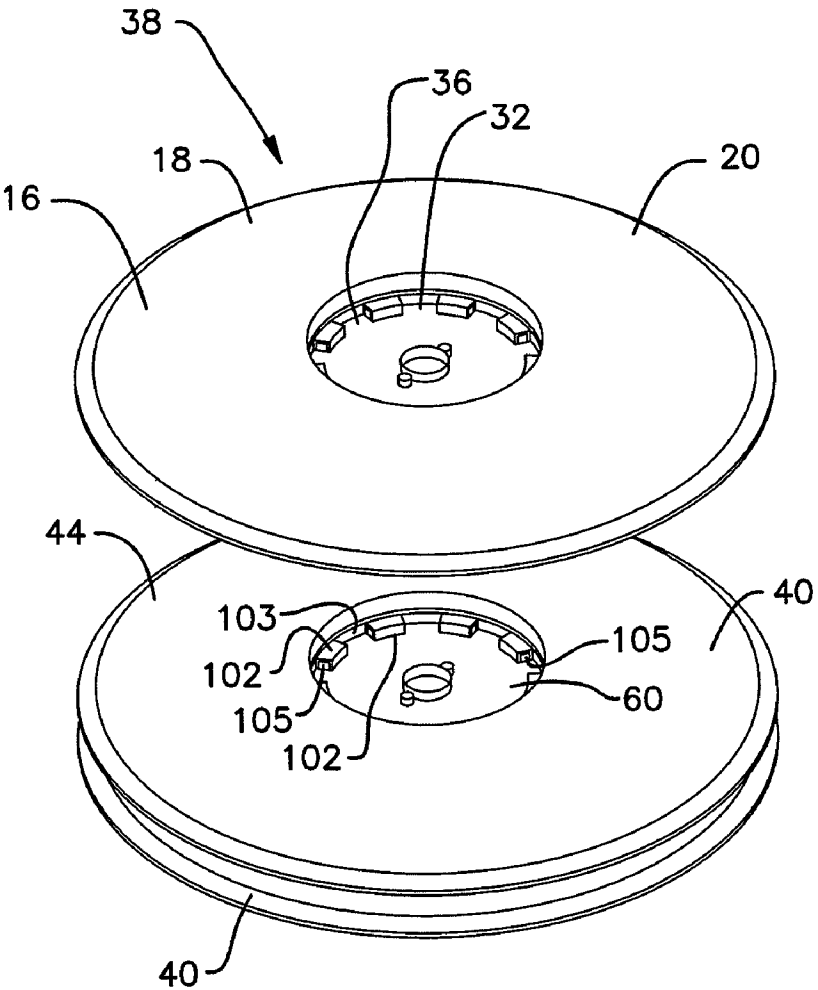
FIG. 5 is a perspective view of an embodiment of parts of the spool arranged in a stack for re-use.

In this embodiment and in reference to FIGS. 4 and 5, the inner side 20 of the first flange wall 18 defines a first hub 32 centered in the inner side 20. In the embodiment shown, the first hub 32 is recessed forming recessed portion 36 within the first flange wall 18. Recessing the first hub 32 from the inner side 20 of the first flange wall 18 allows the hub 32 to protrude at protruding portion 34 from the outer side 22 of the first flange wall 18. This recess/protruding shape of the first hub 32 facilitates nesting or stacking of the flanges 16 relative to one another. FIG. 5 illustrates one embodiment of stacking or nesting the flanges 16. The protrusion 34 of the first hub 32 from the outer side 22 is received within the recess 36 of the inner side 20 of the first flange 16 in another flange that is stacked atop. This allows for a stacked assembly 38 of flanges (FIG. 5) that can be conveniently stored for transport, use, re-use, recycling or assembly. The manner in which the protrusion 34 and recess 36 nests permits neat, safe storage. FIG. 5 shows stacked assembly 38 as including both first flange 16 and second flanges 40, described further below.

In accordance with principles of this disclosure, the spool 12 further includes a second flange 40. In preferred embodiments, the second flange 40 is constructed identically to the first flange 16. In this way, the first flange 16 and second flange 40 are interchangeable allowing for more convenient use. As such, the second flange 40 includes analogous features including second flange wall 42, second flange wall inner side 44, second flange wall outer side 46 (FIG. 4), and outer circular rim 48. The outer side 46 (FIG. 4) includes web arrangement 50 having radial webs 52 and circumferential webs 54. The second flange wall 42 defines a second hub 56 having a protruding part 58 and a recessed part 60. As such, the second flange 40 can be part of the stacked assembly 38.

In accordance with principles of this disclosure, the spool 12 includes a barrel 70. The barrel 70 has a loading surface 72 that is used to hold the product 14.

In the embodiment shown, the barrel 70 is tubular in shape, and in particular, is illustrated as being cylindrical in shape. The barrel 70 connects the first flange 16 to the second flange 40 so that the first flange inner side 20 faces the second flange inner side 44. In this manner, the convex shapes of the respective inner sides 20, 44 face each other. These facing convex shapes help to prevent the problem of the product 14 getting caught in the side.

In accordance with principles of this disclosure, the barrel 70 is removably connected to the first flange 16 and second flange 40. In the embodiment shown, the barrel 70 has a first end 74 that is removably connected to the first flange 16 and a second end 76 removably connected to the second flange 40. In preferred embodiments, the first end 74 is removably connected to the connected to the first hub 32, and the second end 76 is removably connected to the second hub 56.

In one implementation, the first hub 32 and the barrel 70 are removably connected with a first projection-recess arrangement 80. In the embodiment shown, there is also an identical second projection-recess arrangement 82 that connects the second hub 56 and barrel 70.

In the embodiment shown, a first flexible cord 84 is used to secure the first projection-recess arrangement 80, and a second flexible cord 86 is used to secure the second projection-recess arrangement 82. Preferably, the first cord 84 and second cord 86 each are flexible members made of plastic having a respective gripper handle 88, 89 angled relative to a remaining portion 90, 91 of the cord 84, 86.

In the embodiment shown, the first projection-recess arrangement 80 includes an arrangement in which the first hub 32 defines a first plurality of spaced teeth 94. In the embodiment shown, the first plurality of spaced teeth 94 are circumferentially spaced about a periphery of the first hub 32 and separated by first spaces 95 or recesses 95, so that the teeth 94 and recesses 95 together form a first teeth/recess arrangement. In the embodiment shown, the teeth 94 are evenly spaced. Of course, a variety of arrangements are possible. The teeth 94 define first teeth passages 93 or apertures 93 extending through the circumferential area of each.

The first projection-recess arrangement 80 further includes that the first end 74 of the barrel 70 defines that the first plurality of projections 96 received by the first recesses 95. The projections 96 are separated by spaces 101 or recesses 101. The first projections 96 extend from the first end 74 and define a through passage therein. That is, each of the projections 96 is closed at the axial end 98 (FIG. 8) but defines a complete through opening 99 (FIG. 8) extending through the circumferential area of each projection 96. The first plurality of projections 96 is sized and shaped such that it will be received within the first plurality of recesses 95 between teeth 94. The first cord 84 extends through the first passage 99 of the first plurality of projections 96 to removably lock the first flange 16 to the barrel 70. That is, with each projection 96 and being received by one of the recesses 95, the cord 84 is inserted in the passages 93 and 99 in the teeth 94 and projections 96, respectively, and this helps to hold and lock the first flange 16 onto the barrel 70. In FIG. 1, the gripper handle 88 can be seen extending through one of the passages 93.

When it becomes time to disassemble the spool 12, the gripper handle 88 can be grasped and pulled from the projection aperture arrangement 80, which will allow for quickly removing the first flange 16 from the barrel 70.

In the preferred embodiment illustrated, the second projection-recess arrangement 82 is constructed identically to the first projection-recess arrangement 80. In this way, and when having an identical first flange 16 and second flange 40, all of the parts are interchangeable, and any one flange can be used with either end of the barrel 70. Of course, it should be understood that in other implementations, if there is a desire for indexing a flange to be in a particular orientation, or if there is a use for flanges having different geometry, then the projection-recess arrangements 80, 82 can be constructed and arranged to ensure that only a particular type of flange is received on one of the particular ends of the barrel 70.

The second projection-recess arrangement 82 includes a second plurality of teeth 102 separated by spaces 103 or recesses 103 having circumferential second teeth passages 105 (FIG. 5), so that the teeth 102 and recesses 103 together form a second teeth/recess arrangement. The second end 76 of the barrel 70 includes a second plurality of projections 104 separated by spaces 107 or recesses 107 and forming a through passage 109. The second cord 86 extends through the through passages 105, 109 to removably lock the second flange 40 to the barrel 70, as explained above with respect to the first cord 84 and the first flange 16.

The first flange 16 and second flange 40 also includes, in the embodiment shown in FIG. 4, drive pin holes 130, 132. The drive pin holes 130, 132 are sized to receive drive pins such that they can be rotated for winding or unwinding product 14. The drive pin holes 130, 132 are shouldered, such that they are more robust for handling repeated use of the flanges 16, 40.

In preferred embodiments, the first flange 16 and second flange 40 define a dimpled surface to facilitate simplified removal of adhesively applied labels, for example, which helps in cleaning the flanges 16, 40 and promotes re-use.

Figure 7:
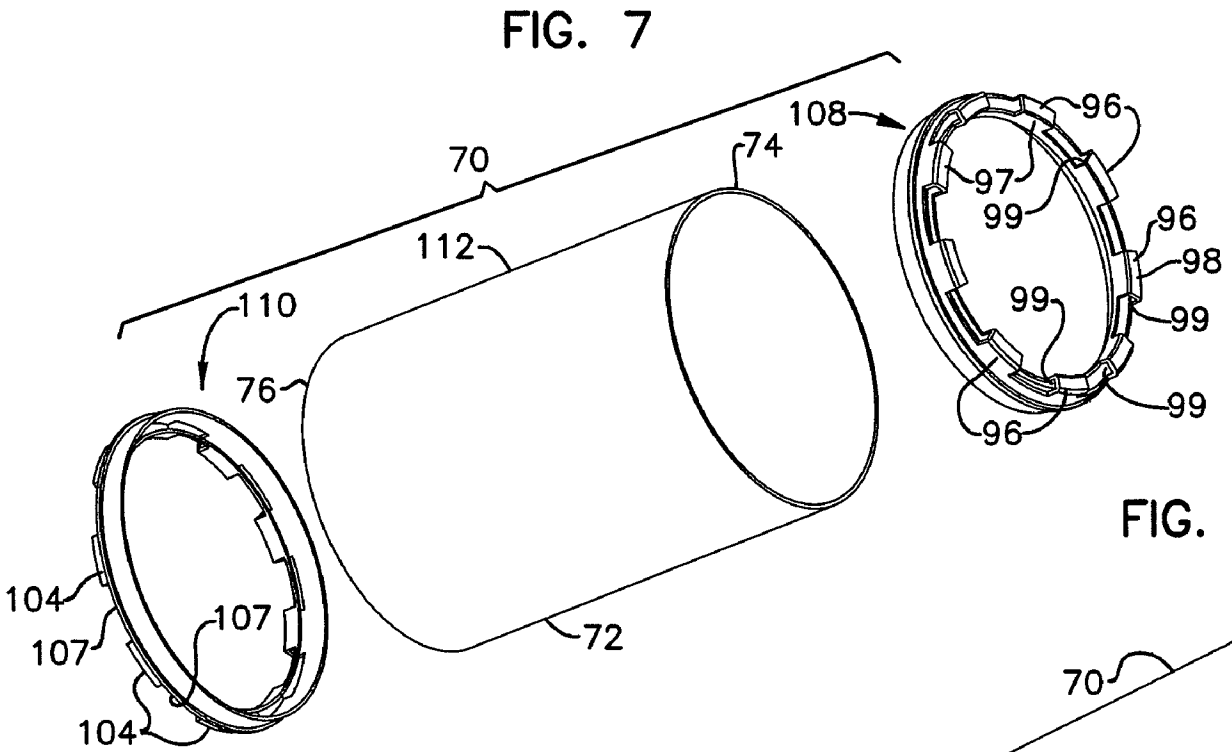
FIG. 7 is an exploded perspective view of one embodiment of a barrel used in the spool of FIGS. 1-4.
Figure 8:
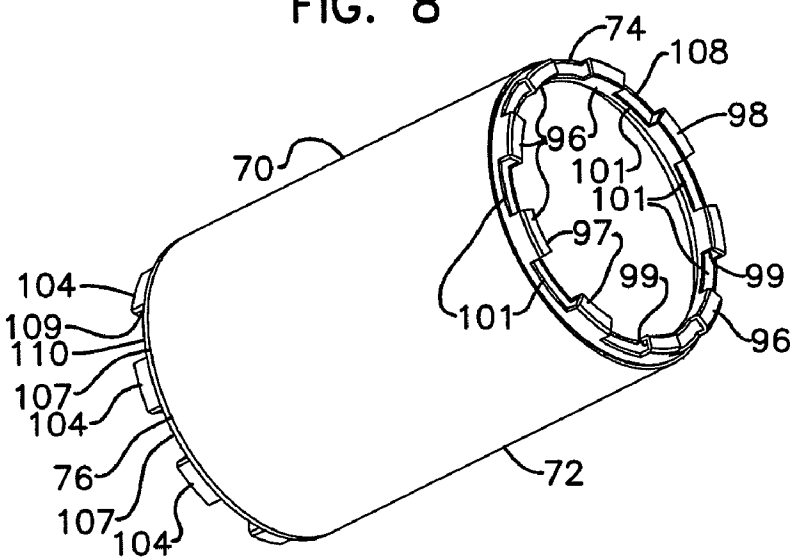
FIG. 8 is a perspective view of one embodiment of a barrel used in the spool of FIGS. 1-4.

The barrel can be made in many different ways. One manner is illustrated in FIG. 7. In this embodiment, the barrel 70 has first and second endcaps 108, 110. The first endcap 108 is secured to the first end 74 of the barrel body 112. Preferably, the first endcap 108 is secured to the barrel body 112 by way of ultrasonic welding, in order to comply with recommendations established by CONEG (Coalition of Northeast Governors). As can be seen in FIG. 8, the first endcap 108 defines the first plurality of spaced projections 96. The second endcap 110 similarly is secured to the second end 76 barrel body 112 by of ultrasonic welding. The second endcap 110 is illustrated as defining the second plurality of projections 104. The endcaps 108, 110 are constructed and arranged to allow a washing nozzle to extend into the barrel 70 and wash the inside of it.

Figure 9:
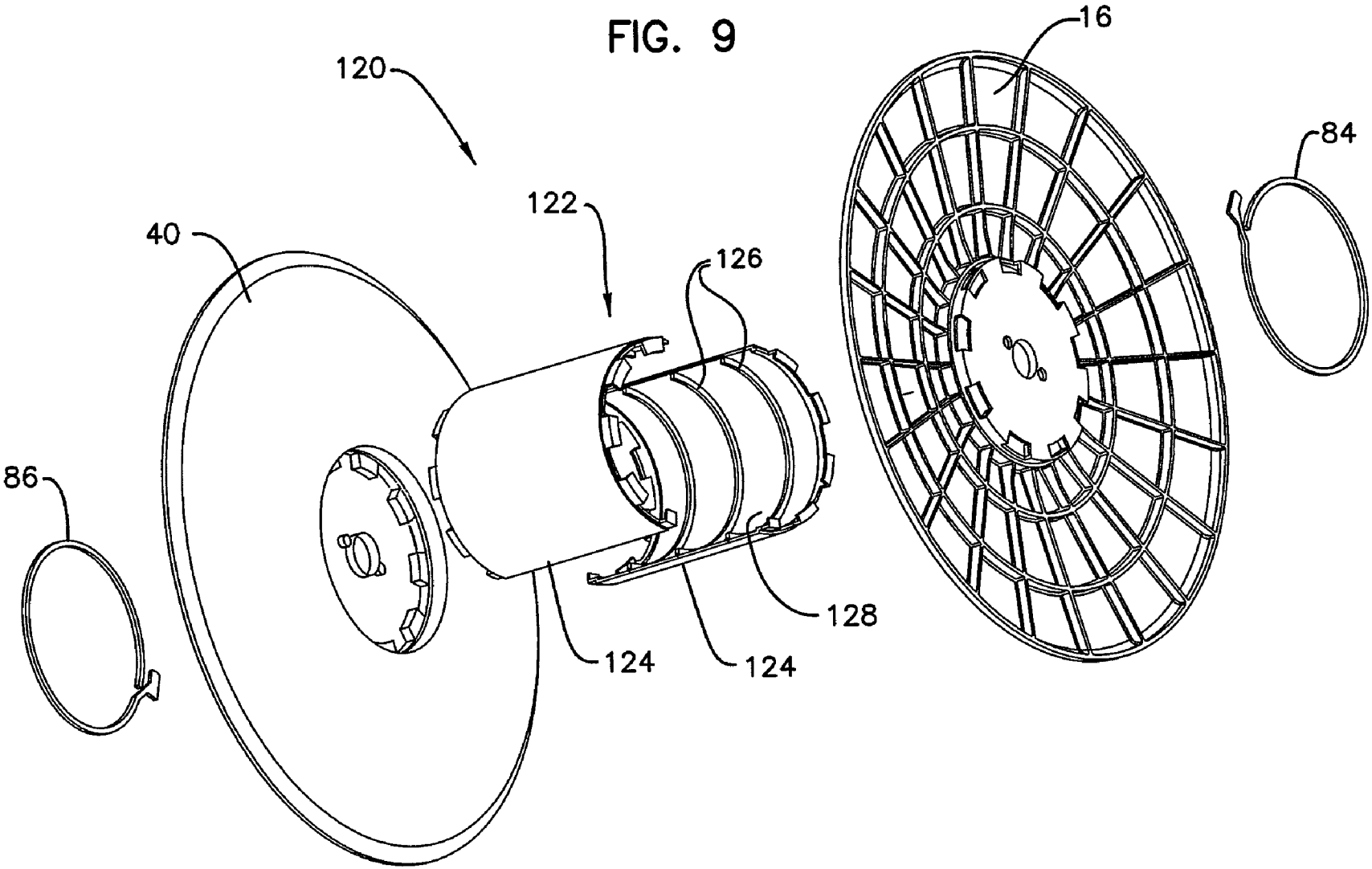
FIG. 9 is an exploded perspective view of a second embodiment of a kit for assembling a reusable take-apart spool constructed in accordance with principles of this disclosure, the barrel being a take-apart barrel.
Figure 10:
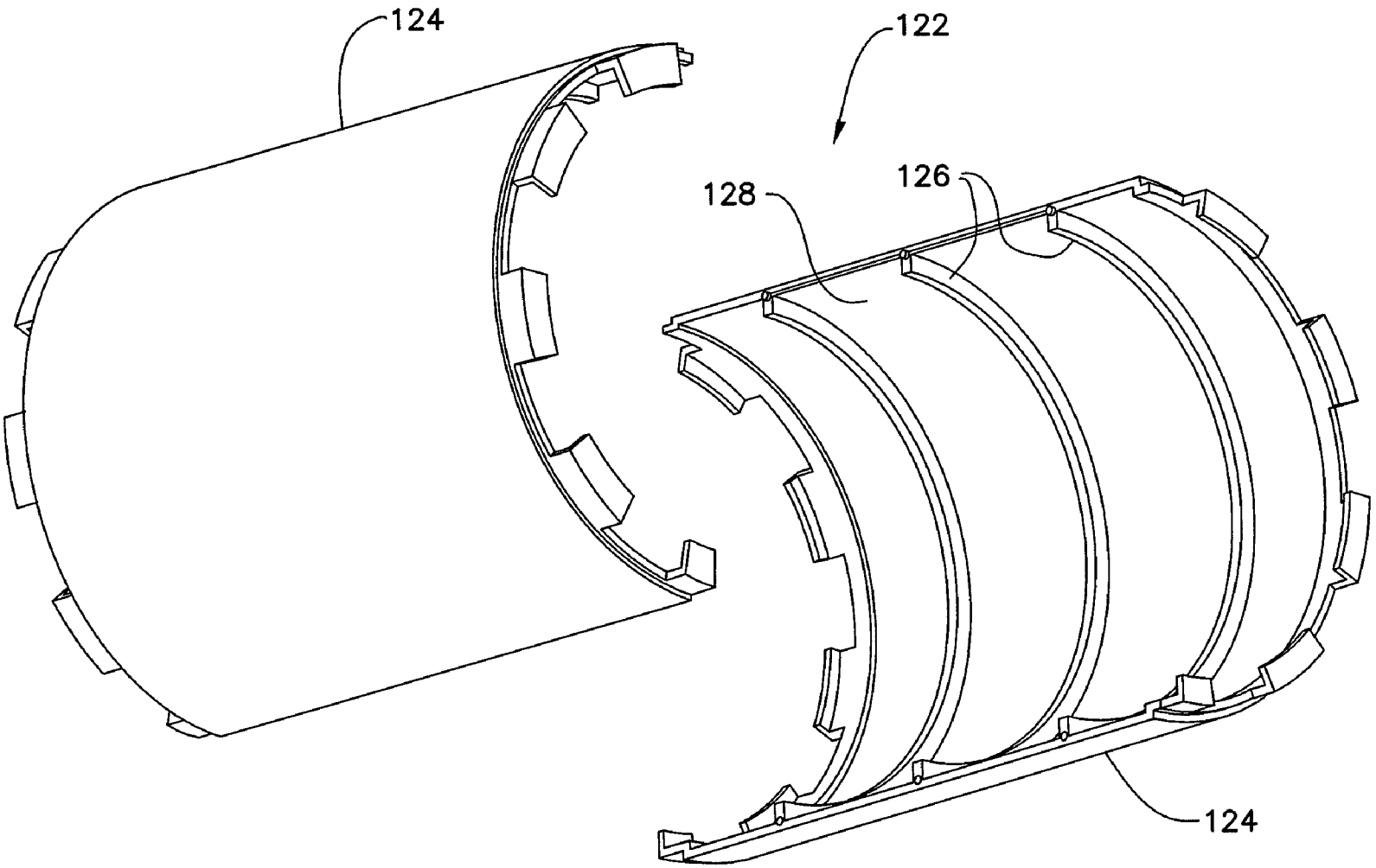
FIG. 10 is an exploded perspective view of the take-apart barrel of FIG. 9.

In another embodiment illustrated in FIGS. 9 and 10, the spool 120 includes first flange 16, second flange 40, first cord 84, second cord 86 and a multiple-piece barrel 122. In the embodiment shown, the multi-piece barrel 122 includes at least two pieces, shown as halves 124 that are removably connected together. Reinforcing ribs 126 can be seen lining the inner circumferential surface 128 of the barrel 122. The halves 124 can be connected together by a variety of means including basic projection/slot receivers and other types of connections. When the multiple-piece barrel 122 is used, then the barrels 122 can also be disassembled and stored by stacking the halves 124 for use, transport, re-use, assembly or recycling.

In accordance with principles of this disclosure, a kit 140 (FIG. 4) is provided for assembling the take-apart spool 12. The kit will include at least two flanges (a pair of flanges), such as flanges 16, 40. Of course, in this embodiment, the first flange 16 and the second flange 40 are identical. Therefore, providing at least two flanges can be providing a plurality of flanges constructed like the first flange 16. The kit 140 further includes a barrel, such as barrel 70. The barrel 70 has loading surface 72 and has opposite ends, such as first end 74 and second end 76. These ends are constructed and arranged to be removably connected to the respective hubs of the flanges 16, 40. First and second cords 84, 86 are also provided as part of the kit 140. Of course, in this embodiment, the first cord 84 and second cord 86 are preferably identical.

A method of using a spool is provided. One implementation includes orienting projection arrangement 96 of the first 74 of the barrel 70 into recesses 95 of the hub 32 of the first flange 16. Next, the first cord 84 is oriented through the passages 93, 99 to lock the first flange 16 to the barrel 70. Similarly, the method then includes orienting projection arrangement 104 of the second end 76 of the barrel 70 into recesses 103 of the hub 56 of the second flange 40. Next, the second cord 86 is oriented through the passages 105, 109 to lock the second flange 42 to the barrel 70. The first flange 16 and second flange 40 are oriented on the barrel 70 such that the inner convex side 44 of the second flange 40 is facing the inner convex side 20 of the first flange 16. The spool 12 is then ready for use by winding material, such as product 14, onto the barrel 70.

In use, the method further includes unwinding the material or product 14 from the barrel 70. Then, when all of the usable material has been unwound from the barrel 70, the spool 12 is disassembled. The step of disassembling the spool 12 includes removing the first cord 84 and the second cord 86 to separate each of the first flange 16, second flange 40, and barrel 70. The step of removing the first cord 84 includes grasping the first gripper handle 88 and pulling it through the passages of the first projection-recess arrangement 80. Similarly, the step of removing includes grasping the gripper handle 89 of the second cord 86 and removing it from the passages of the second projection-recess arrangement 82.

Preferably, after the step of disassembling, the flanges 16, 40 are stacked together by nesting the recessed portions 36, 60 and protruding portions 34, within each other. That is, a protruding portion 58, 34 is arranged to be received an adjacent recessed portion 36, 60 of an adjacent flange 16, 40.

In one embodiment, there is a further step of separating barrel 122 into two halves 124, and then stacking the barrel halves 124.

The various pieces of the spool 12 can then be cleaned by washing and made available for assembly and re-use. Preferably, edges and recessed areas of the spool flanges 16, 40 have radii to facilitate good washing practices.

This disclosure includes examples of implementations of inventive principles. Many embodiments are possible applying these same inventive principles.

What is claimed is:

1. A reusable take-apart washable spool comprising:

(a) a first flange having a first flange wall;

(i) the first flange wall having inner and outer opposite sides;

(ii) the first flange wall defining an outer circular rim of a diameter of at least 10 inches;

(iii) the inner side of the first flange wall being convex and defining a first hub centered in the inner side;

(A) the first hub being recessed within the first flange wall;

(b) a second flange having a second flange wall;

(i) the second flange wall having inner and outer opposite sides;

(ii) the second flange wall defining an outer circular rim of a diameter of at least 10 inches;

(iii) the second flange wall inner side being convex and defining a second hub centered in the inner side;

(A) the second hub being recessed within the second flange wall; and (c) a barrel having a loading surface with first and second opposite ends; the barrel connecting the first flange and the second flange so that the first flange inner side faces the second flange inner side;

(i) the first end of the barrel being removably connected to the first hub;

(A) the first hub and barrel having a first projection-recess arrangement to connect the first end of the barrel to the first hub, the first projection-recess arrangement defining a circumferential first through passage;

(B) a first cord extending through the circumferential first through passage removably locking the first flange to the barrel; and (ii) the second end of the barrel being removably connected to the second hub.

2. A spool according to claim 1 wherein:

(a) the second hub and barrel are removably connected with a second projection-recess arrangement; the second projection-recess arrangement defining a circumferential second through passage;

(i) a second cord extending through the second through passage removably locking the second flange to the barrel;.

3. A spool according to claim 2 wherein:

(a) the first cord has a first gripper handle angled relative to a remaining portion of the first cord; and (b) the second cord has a second gripper handle angled relative to a remaining portion of the second cord.

4. A spool according to claim 1 wherein:

(a) the first flange outer side is concave, and the first hub is centered therewithin;

(i) the first hub projecting from the first flange outer side; and (b) the second flange outer side is concave, and the second hub is centered therewithin;

(i) the second hub projecting from the second flange outer side.

5. A spool according to claim 4 wherein:

(a) the first flange outer side includes a web arrangement; and (b) the second flange outer side includes a web arrangement.

6. A spool according to claim 1 wherein:

(a) the barrel comprises at least two halves that are removably connected together.

7. A spool according to claim 1 wherein:

(a) the first flange and second flange each defines a shouldered drive pin hole.

8. A method of using a spool; the method comprising:

(a) orienting a projection arrangement of a first end of a barrel into recesses of a hub of a first flange; the first flange having an inner convex side facing the barrel; the projection arrangement defining a circumferential first through passage;

(b) orienting a first cord through the first through passage of the projection arrangement and the recesses of the hub to lock the first flange to the barrel;

(c) orienting a projection arrangement of a second end of the barrel into recesses of a hub of a second flange; the second flange having an inner convex side facing the barrel and facing the first flange; the projection arrangement of the second end of the barrel defining a circumferential second through passage;

(d) orienting a second cord through the second through passage of the projection arrangement of the second end of the barrel and the recesses of the hub of the second flange to lock the second flange to the barrel; and (e) winding material onto the barrel.

9. A method according to claim 8 further comprising:

(a) unwinding material from the barrel; and then (b) disassembling the spool by removing the first cord and the second cord to separate each of the first flange, barrel, and second flange.

10. A method according to claim 9 further comprising:

(a) after the step of disassembling, stacking the flanges together by nesting the hubs.

11. A method according to claim 10 further comprising:

(a) after the step of disassembling, separating the barrel into two halves and stacking the two barrel halves.

12. A method according to claim 9 further comprising:

(a) after the step of disassembling, washing the first and second flanges and the barrel.

13. A reusable take-apart washable spool comprising:

(a) a first flange having a first flange wall;

(i) the first flange wall having inner and outer opposite sides;

(ii) the first flange wall defining an outer circular rim of a diameter of at least 10 inches;

(iii) the inner side of the first flange wall being convex and defining a first hub centered in the inner side;

(A) the first hub being recessed within the first flange wall;

(b) a second flange having a second flange wall;

(i) the second flange wall having inner and outer opposite sides;

(ii) the second flange wall defining an outer circular rim of a diameter of at least 10 inches;

(iii) the second flange wall inner side being convex and defining a second hub centered in the inner side;

(A) the second hub being recessed within the second flange wall;

(c) a barrel having a loading surface with first and second opposite ends; the barrel connecting the first flange and the second flange so that the first flange inner side faces the second flange inner side;

(i) the first end of the barrel being removably connected to the first hub with a first projection-recess arrangement;

(ii) the second end of the barrel being removably connected to the second hub with a second projection-recess arrangement;

(d) wherein the first projection-recess arrangement includes:

(i) the first hub defining a first plurality of teeth separated by first recesses;

the first plurality of teeth having first teeth-through passages;

(ii) the first end of the barrel defining a first plurality of projections received by the first recesses;

(A) the first plurality of projections defining a first through passage;

(e) wherein the second projection-recess arrangement includes:

(i) the second hub defining a second plurality of teeth separated by second recesses; the second plurality of teeth having second teeth-through passages;

(ii) the second end of the barrel defining a second plurality of projections received by the second recesses;

(A) the second plurality of projections defining a second through passage;

(f) a first cord extending through the first through passage and first teeth through passages to removably lock the first flange to the barrel; and (g) a second cord extending through the second through passage and second teeth through passages to removably lock the second flange to the barrel.

14. A spool according to claim 13 wherein:

(a) the first flange outer side is concave, and the first hub is centered therewithin;

(i) the first hub projecting from the first flange outer side; and (b) the second flange outer side is concave, and the second hub is centered therewithin;

(i) the second hub projecting from the second flange outer side.

15. A spool according to claim 13 wherein:

(a) the barrel comprises at least two halves that are removably connected together.

16. A spool according to claim 13 wherein:

(a) the first flange and second flange each defines a shouldered drive pin hole.

17. A spool according to claim 13 wherein:

(a) the first plurality of spaced teeth are circumferentially spaced about a periphery of the first hub; and (b) the second plurality of spaced teeth are circumferentially spaced about a periphery of the second hub.

18. A spool according to claim 13 wherein:

(a) the first cord has a first gripper handle angled relative to a remaining portion of the first cord; and (b) the second cord has a second gripper handle angled relative to a remaining portion of the second cord.

19. A kit for assembling a reusable take-apart spool; the kit comprising:

(a) a pair of flanges; each of the flanges in the pair having a flange wall;

(i) each flange wall having inner and outer opposite sides;

(ii) each flange wall defining an outer circular rim of a diameter of at least 10 inches;

(iii) each inner side of the flange wall being convex and defining a hub centered in the inner side;

(A) each hub being recessed within the flange wall;

(b) a barrel having a loading surface with first and second opposite ends;

(i) the first end of the barrel being constructed and arranged to be removably connected to the hub of one of the flanges of the pair of flanges; and (ii) the second end of the barrel being constructed and arranged to be removably connected to the hub of the other flange of the pair of flanges;

(iii) each of the hubs defining a plurality of recesses;

(iv) the first and second ends of the barrel each defining a plurality of projections sized to be received by the recesses; each of the plurality of projections defining a through passage;

(c) a first cord sized to extend through the through passage of one of the hubs; and (d) a second cord sized to extend through the through passage of the other of the hubs.

20. A kit according to claim 19 wherein:

(a) each flange outer side is concave with the first hub centered therewithin and projecting therefrom.

* * * * *